US006018918A

United States Patent [19]

Long, Sr.

[11] Patent Number: 6,018,918

[45] Date of Patent: Feb. 1, 2000

[54] WALL PANEL WITH VAPOR BARRIERS

[75] Inventor: Robert T. Long, Sr., Ames, Iowa

[73] Assignee: Composite Technologies Corporation, Ames, Iowa

[21] Appl. No.: 08/951,768

[22] Filed: Oct. 16, 1997

[51] Int. Cl.[7] ..... E04B 1/68

[52] U.S. Cl. ..... 52/408; 52/100; 52/379; 52/396.05; 52/309.12; 52/309.17; 52/741.3; 52/741.5; 52/586.1

[58] Field of Search ..... 52/309.9, 309.11, 52/309.12, 309.17, 408, 410, 405.1, 222, 396.02, 716.8, 741.3, 741.4, 742.12, 745.05, 250, 379, 412, 747.12, 100, 267, 63, 268, 396.04, 396.05, 586.1; 264/31, 34, 35; 428/317.1, 319.7

[56] References Cited

U.S. PATENT DOCUMENTS

| | | | |
|---|---|---|---|
| 456,407 | 7/1891 | Davidson | 52/100 |
| 1,958,049 | 5/1934 | Kleitz . | |
| 2,412,744 | 12/1946 | Nelson . | |
| 2,423,695 | 7/1947 | Falco | 52/396.02 X |
| 2,645,929 | 7/1953 | Jones . | |
| 2,653,469 | 9/1953 | Callan . | |
| 2,775,018 | 12/1956 | McLaughlin . | |
| 3,274,680 | 9/1966 | Cruse . | |
| 3,426,494 | 2/1969 | Hala . | |
| 3,512,318 | 5/1970 | Turner | 52/100 |
| 3,593,478 | 7/1971 | Mason . | |
| 3,601,943 | 8/1971 | Danois | 52/396.05 |
| 3,724,155 | 4/1973 | Reeve | 52/396.04 X |
| 3,750,355 | 8/1973 | Blum . | |
| 3,927,857 | 12/1975 | Lovisa et al. . | |
| 3,964,220 | 6/1976 | Rutlowski et al. | 52/100 |
| 3,965,635 | 6/1976 | Renkert . | |
| 4,052,831 | 10/1977 | Roberts et al. . | |
| 4,109,436 | 8/1978 | Berloty . | |
| 4,189,880 | 2/1980 | Ballin | 52/22 X |
| 4,226,071 | 10/1980 | Bennett | 52/409 X |
| 4,283,896 | 8/1981 | Fricker et al. . | |
| 4,329,821 | 5/1982 | Long et al. | 52/309.12 |
| 4,348,847 | 9/1982 | Jukes . | |
| 4,393,635 | 7/1983 | Long . | |
| 4,489,530 | 12/1984 | Chang . | |
| 4,545,163 | 10/1985 | Asselin . | |
| 4,568,554 | 2/1986 | Riley et al. | 52/309.8 |
| 4,577,445 | 3/1986 | Price | 52/396.04 |
| 4,624,089 | 11/1986 | Dunker . | |
| 4,651,488 | 3/1987 | Nicholas et al. | 52/100 X |
| 4,677,800 | 7/1987 | Roodvoets | 52/309.12 |
| 4,702,053 | 10/1987 | Hibbard . | |
| 4,712,349 | 12/1987 | Riley et al. | 52/408 |
| 4,779,673 | 10/1988 | Chiles et al. . | |
| 4,805,366 | 2/1989 | Long | 52/268 X |
| 4,817,655 | 4/1989 | Brooks | 52/222 X |
| 4,829,733 | 5/1989 | Long . | |
| 4,922,676 | 5/1990 | Spronken | 52/396.05 |
| 4,974,381 | 12/1990 | Marks . | |
| 5,002,620 | 3/1991 | King | 52/309.12 X |
| 5,022,459 | 6/1991 | Chiles et al. . | |
| 5,067,298 | 11/1991 | Petersen | 52/309.12 X |
| 5,369,926 | 12/1994 | Borland | 52/309.12 X |
| 5,477,643 | 12/1995 | Koenig | 52/100 |
| 5,519,973 | 5/1996 | Keith et al. . | |
| 5,671,574 | 9/1997 | Long | 52/309.11 |
| 5,673,525 | 10/1997 | Keithe et al. | 52/309.12 |
| 5,679,432 | 10/1997 | Holmquest | 428/71 |
| 5,695,870 | 12/1997 | Kelch et al. | 428/318.4 |

*Primary Examiner*—Robert Canfield
*Attorney, Agent, or Firm*—Zarley, McKee, Thomte, Voorhees & Sease

[57] ABSTRACT

An improved concrete wall structure is provided with an insulation layer sandwiched between concrete layers. The insulation layer includes a vapor film on at least one side. An extruded channel member is fit onto the edge of a sheet of insulation and has a vapor film fit into a longitudinal groove extending along the channel member. The vapor films on the channel members of adjacent wall panels cooperate to bridge the gap between adjacent panels and thereby provide a vapor seal in the space between the adjacent panels.

14 Claims, 3 Drawing Sheets

WALL PANEL WITH VAPOR BARRIERS

BACKGROUND OF THE INVENTION

In designing and building freezers, coolers, and food processing facilities wherein temperature control is important, one of the main challenges is the creation of a building envelope that provides maximum efficiency of heating, ventilating, and air conditioning (HVAC), while controlling the transfer of condensation and vapor within a secure, sanitary environment. A conventional wall for such facilities has been built with insulated metal panels. However, such metal panels are not energy efficient due to a lack of mass that can create a thermal lag effect that can compensate for wide temperature fluctuations. Metal panels also have an inherent lack of security due to the thin metal skin of the panels, which can be easily punctured, for example by a fork lift blade. Finally, metal panels have low fire resistance, and therefore can lead to high insurance costs.

Concrete panels have also been used for building freezers, coolers, and food processing facilities. Typically, the concrete panels include two concrete layers between which is sandwiched an insulation layer of extruded polystyrene foam. Fiber composite connectors bond the multi-layered wall together so as to provide an energy efficient and secure building structure. However, such concrete panels may have problems with condensation and vapor transfer, particularly at the joints between adjacent panels and through the connector holes in the insulation. Also, the concrete layers tend to bond with the foam layer, thereby preventing or detrimentally affecting the desirable relative movement between the concrete and the foam during thermal expansion and contraction.

Therefore, a primary objective of the present invention is the provision of an improved thermally efficient wall structure.

Another objective of the present invention is the provision of a multi-layer concrete wall panel having a vapor barrier.

A further objective of the present invention is the provision of an improved insulation layer for a concrete wall panel.

A further objective of the present invention is the provision of a channel on the edge of a concrete wall panel to which a vapor film can be easily attached.

Still another objective of the present invention is the provision of a method of forming a wall structure to prevent bonding between the insulation layer and adjacent concrete layers.

Another objective of the present invention is the provision of a vapor barrier device for use between adjacent panels of a building structure.

A further objective of the present invention is the provision of a method of forming a wall structure having a vapor barrier.

These and other objectives will become apparent from the following description of the invention.

SUMMARY OF THE INVENTION

The wall structure of the present invention includes first and second concrete layers between which an insulation layer is sandwiched. The insulation layer includes a film layer on each side. One of the film layers forms a vapor barrier to prevent transfer of condensation and vapor from the warm side of the wall panel to the cooler side of the wall panel. Both film layers prevent bonding between the concrete layers and the insulation layer.

A vapor barrier is also provided between adjacent concrete panels. An elongated channel member is fit over the edge of the insulation layer. The channel member has a groove extending longitudinally with a tab which covers the groove during formation of the wall panel. The tab is removable after the concrete has cured. A vapor film is spliced into the groove. Adjacent panels are abutted against one another, with an edge of the vapor film of each panel extending outwardly through a small gap between the adjacent outer concrete layers. The film edges are welded and rolled together. The roll is then forced into the gap, and the gap is then sealed with a sealant. Welding can be effected using heat, solvents, or other known methods or devices.

DETAILED DESCRIPTION OF THE DRAWINGS

Figure 1:
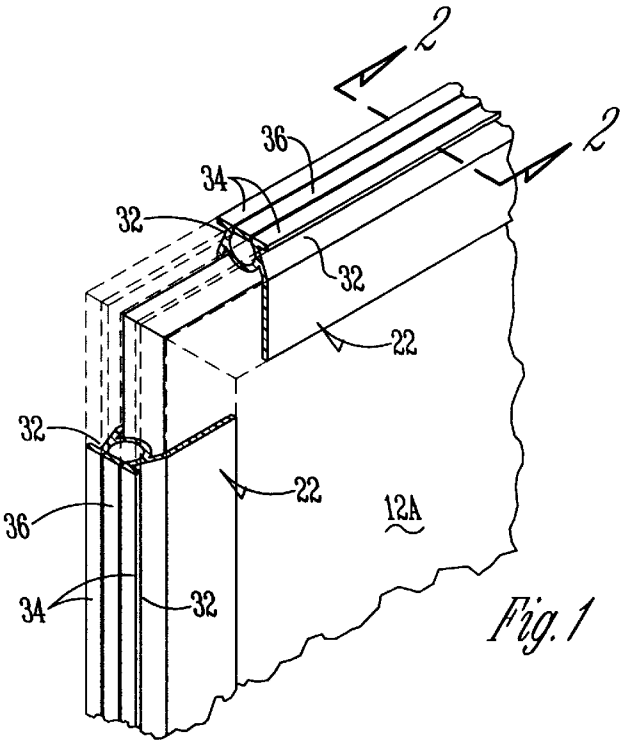
FIG. 1 is a partial perspective view of an insulation foam layer for a concrete wall panel, with the extruded channel member of the present invention mounted along the edges of the insulation layers.
Figure 2A:
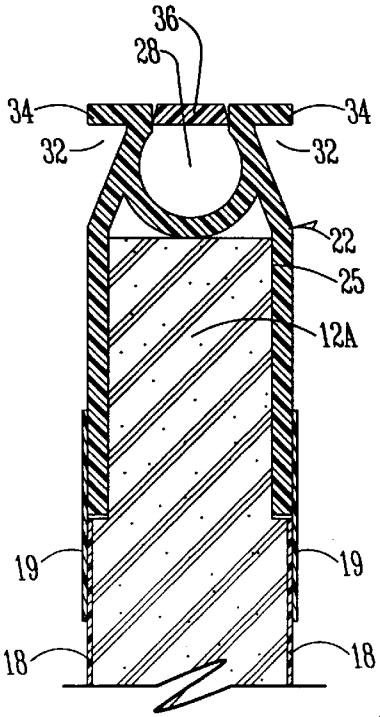
FIG. 2A is a view similar to FIG. 2 showing an alternative edge for the insulation layer.
Figure 2:
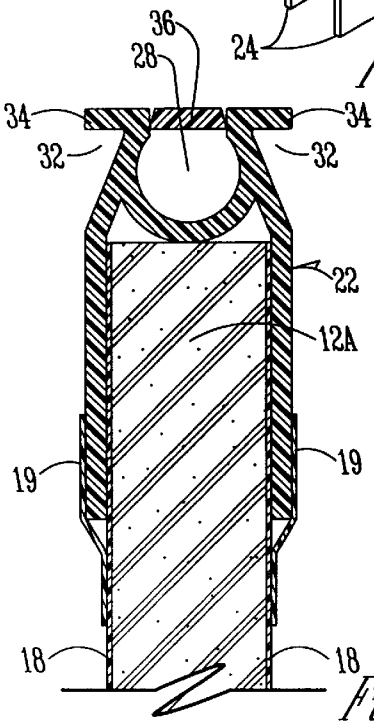
FIG. 2 is an enlarged sectional view taken along lines 2—2 of FIG. 1.
Figure 4:
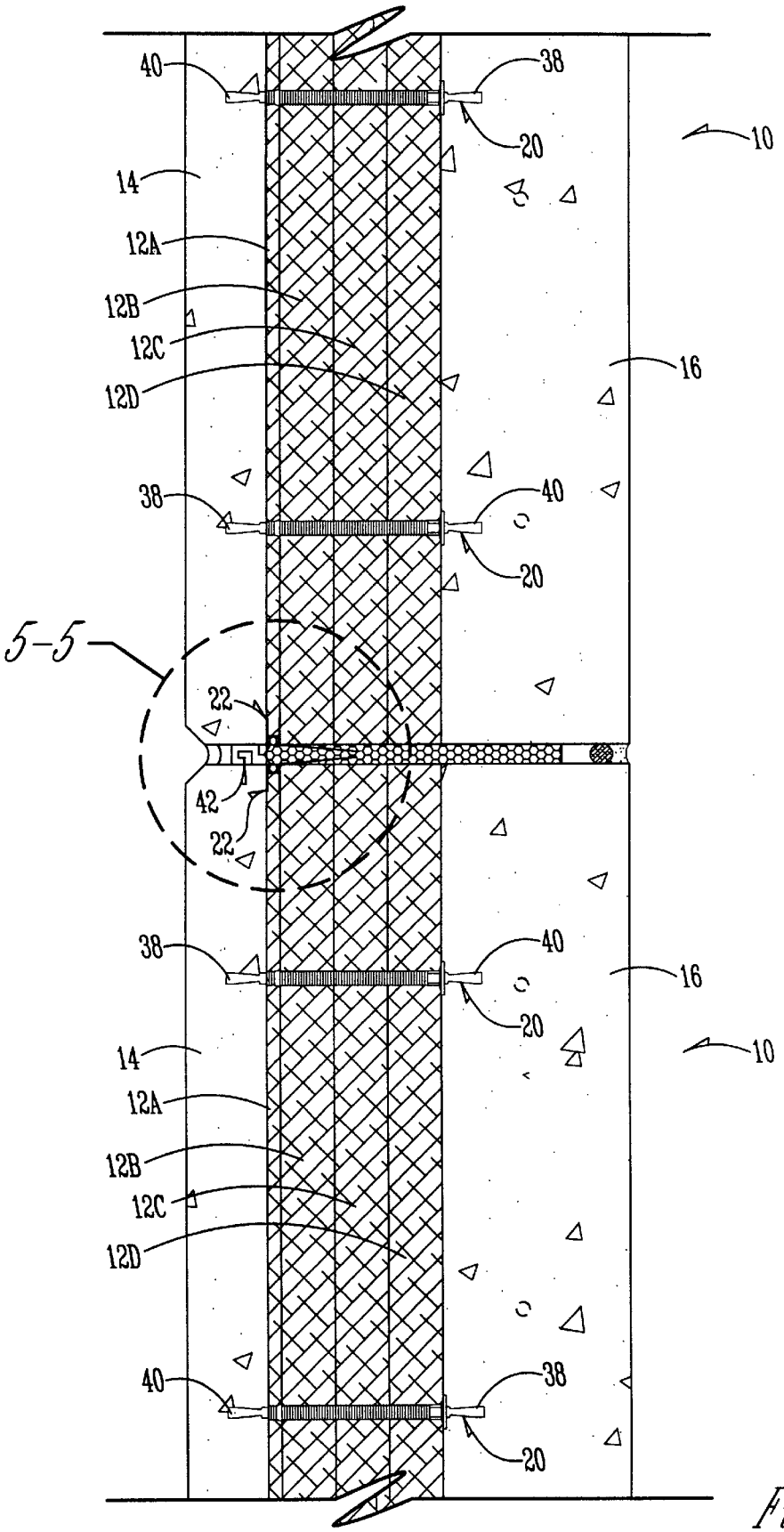
FIG. 4 is a partial sectional view showing adjacent concrete wall panels having multiple insulation sheets.

With reference to the drawings, a wall panel 10 includes a foam insulation layer 12 sandwiched between a first concrete layer 14 and a second concrete layer 16. The insulation layer 12 may be one or more sheets or panels, such as a sheet 12A of ½ inch insulation and three sheets 12B, 12C, 12D of 2 inch insulation, to create a 6 ½ inch layer of insulation, as seen in FIG. 4. As best seen in FIG. 2, the insulation layer 12 includes a thin film 18 laminated on each side of sheet 12A. The insulation layer 12 with the laminated film 18 is pre-drilled with holes through sheets 12A–12C to receive connectors 20 having opposite ends which extend into the respective concrete layers 14, 16, as shown in FIG. 4.

Since moisture migrates from the warm side of a wall to the cooler side of the wall, the film 18 adjacent the first or outer concrete layer 14 acts as a vapor barrier. The film 18 around the pre-drilled holes stretches to tightly engage the connectors 20, thereby providing a seal around each connector 20. Providing a sheet of the film 18 on each side of the insulation sheet 12A also prevents warping of the insulation during the lamination process, which would occur if a layer of the film 18 is used only on one side of the insulation sheet 12A.

Figure 3:
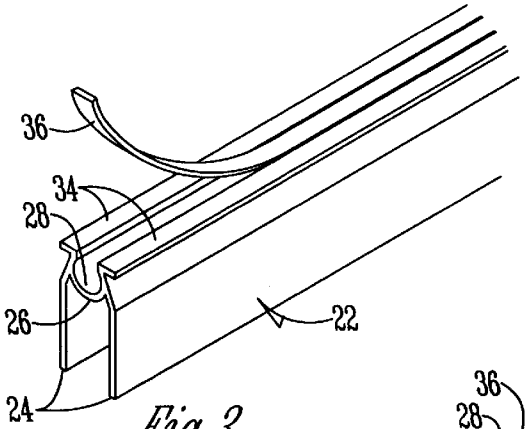
FIG. 3 is a perspective view of the extruded channel with the tab partially removed.

An extruded channel member 22 is adapted to fit over the edges of the insulation sheet 12A. The channel member 22 includes opposite legs 24 and an interconnecting web 26. The web 26 includes a groove 28 extending longitudinally along the channel member 22. The web 26 also includes a reduced width portion 32 which terminates in outwardly extending ears 34, as best seen in FIG. 2. A removable tab 36 is integrally formed on the channel member 22 in covering relation over the groove 28. FIG. 3 shows the tab in a partially removed condition. Before the tab 36 is removed, the groove 28 is closed. The groove 28 is opened upon removal of the tab 36.

In forming the wall panel 10, the extruded channel member 22 is fit over the edge of the insulation sheet 12A, with the tab 36 in place. Adhesive or tape 19 may be used to secure the legs 24 of the channel member 22 to the film 18 on the insulation sheet 12A. Alternatively, the legs 24 of the channel member 22 can be crimped to provide a mechanical lock with the insulation sheet 12A. Still another option is to provide a milled or molded edge 25, as shown in FIG. 2A, on each face of sheet 12A to provide a consistent mating surface for each leg 24. The pre-drilled connector holes may be formed before or after the channel member 22 is mounted on the edge of the insulation sheet 12A.

Figure 6:
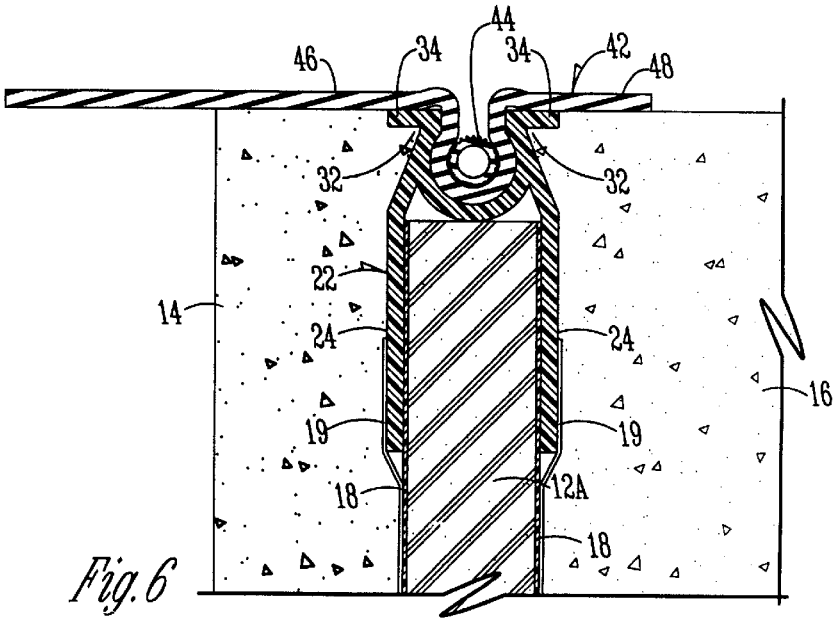
FIG. 6 is an enlarged sectional view, showing a vapor film in place in the channel member on the edge of a wall panel having a single sheet of insulation.

The first concrete layer 14 is poured into a pre-built form. The insulation layer 12 is set onto the uncured concrete layer 14. The connectors 20 are then pushed through the pre-drilled holes such that the first ends 38 of each connector 20 penetrate the first concrete layer 14. Alternatively, the connectors 20 can be pushed through the insulation layer 12 before the insulation layer is set onto the uncured concrete layer 14. The second layer 16 of concrete is then poured onto the insulation layer 12 so as to cover the second ends 40 of the connectors 20 and thereby form the multi-layer wall panel 10. The uncured concrete works into the adjacent reduced width portion 32 of the channel member 22, thereby providing a mechanical lock between the channel member 22 and the concrete layers 14. As seen in FIG. 6, where a single sheet 12A is used, the concrete layers 14, 16 on each side of the sheet 12A works into the portions 32 of the channel member 22. The ears 34 provide a continuous face so as to eliminate voids in the concrete. As seen in FIG. 4, multiple polystyrene foam insulation sheets 12A–12D may be used between the concrete layers.

The removable tab 36 prevents foreign materials, such as concrete, from entering the groove 28 of the channel member 22 before the vapor film 42 is installed. After the concrete layers 14, 16 have cured, the tab 38 can be removed using pliers or any other convenient tool. A vapor film 42 is then laid across the ears 34 of the channel member and forced into the groove 28. A spline 44 is forced into the groove over the vapor film 42 so as to retain the vapor film 42 in the groove 28. A roller or other convenient tool can be used to force the film 42 and the spline 44 into the groove 28. The film 42 may have any desirable thickness, preferably between 1–100 mil.

Figure 5:
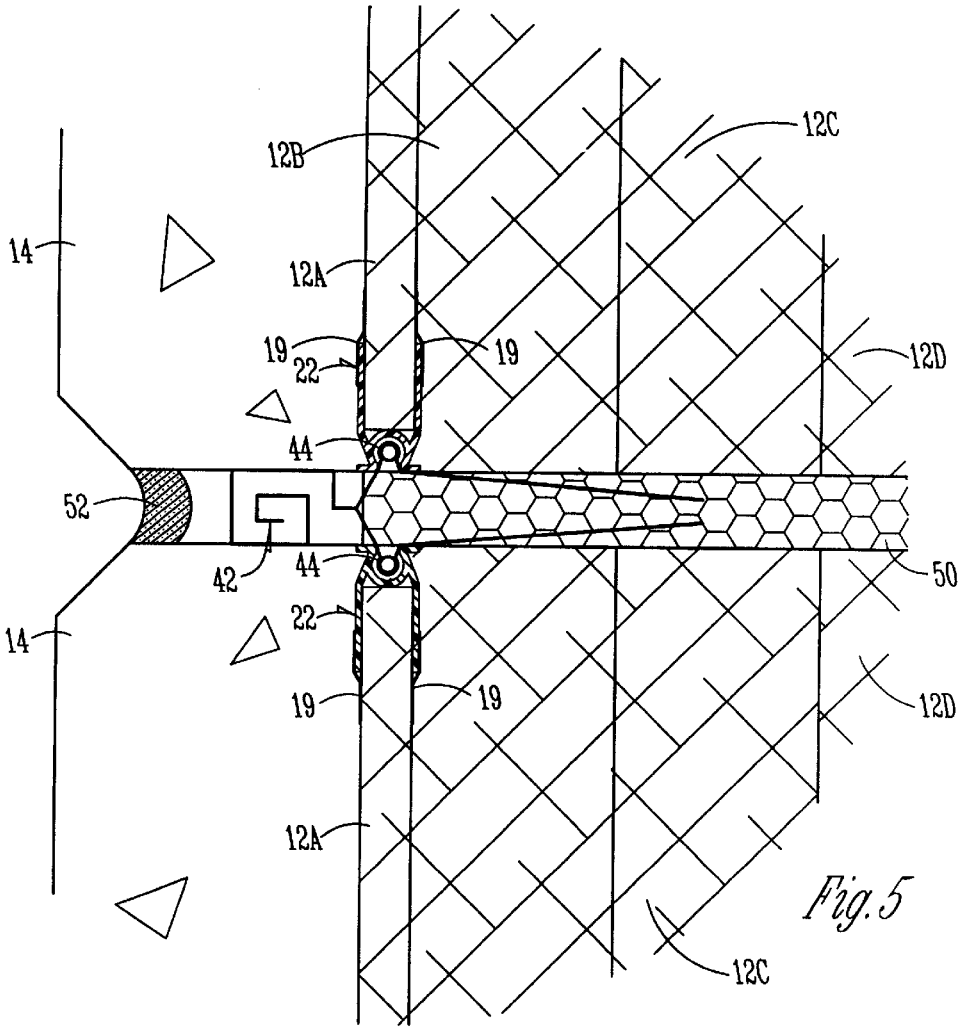
FIG. 5 is an enlarged view taken along lines 5—5 of FIG. 4.

As seen in FIG. 4 and 5, after individual wall panels are erected, adjacent wall panels 10 have a space therebetween. A first edge 46 of the vapor film 42 extends outwardly through the space between the first concrete layers 14, while the second edge 48 of the vapor film 42 extends into the space between the adjacent second concrete layer 16 and beyond the outer surface thereof. A sealant material 50 seals the space between the concrete layers 16 and insulation layers 12, as best seen in FIG. 5. The outwardly extending edges 46 of the adjacent vapor films 42 are rolled together and forced into the space between the outer concrete layers 14, as seen in FIG. 5. Thus, the films 42 sealingly bridge the gap between opposing channel members 22. A bead of sealant 52 is provided over the rolled edges 46 in the gap between the outer concrete layer 14.

Thus, the insulation film 18 and the vapor film 42 each provide vapor barriers for the wall panels 10.

Whereas the invention has been shown and described in connection with the preferred embodiments thereof, it will be understood that many modifications, substitutions, and additions may be made which are within the intended broad scope of the following claims. It will also be understood that the vapor film 42 can be rolled together with similar vapor film or membrane similarly installed in roof or floor junctures. From the foregoing, it can be seen that the present invention accomplishes at least all of the stated objectives.

What is claimed is:

1. A wall structure comprising:

a pair of adjacent panels, each comprising first and second concrete layers with an insulation layer between the concrete layers, with adjacent panels defining a wall joint; and a pair of elongated channel members, each being fit over an edge of the insulation layer on one of the panels and having opposite legs with an interconnecting web;

the web having a groove extending longitudinally along the channel member; and a vapor barrier for the joint of adjacent panels spanning between the pair of channel members and being received in the grooves of the webs.

2. The wall structure of claim 1 wherein the vapor barrier comprises a film, and further comprising a spline fit into each groove to secure the film to the channel members.

3. The wall structure of claim 1 further comprising a removable tab covering the grooves in the channel members before the vapor barrier is inserted into the grooves to prevent entry of the material into the grooves.

4. The wall structure of claim 2 wherein the tab is integrally formed with each channel member.

5. The wall structure of claim 2 wherein the film has an end initially extending out of the joint between adjacent panels and being adapted to be pushed into the joint.

6. The wall structure of claim 1 wherein the vapor barrier comprises a film applied to the insulation layer of each panel, each film having one end initially extending out of the joint between the adjacent panels, and the ends of the films being mated together before being inserted into the joint.

7. The wall structure of claim 6 wherein the ends of the films are mated in the form of a spiral winding.

8. The wall structure of claim 6 further comprising a joint sealing compound applied to the joint after the ends of the films are pushed into the joint.

9. A method of forming a wall structure, comprising:

(a) fitting an elongated channel member onto an edge of a sheet of insulation, the sheet of insulation forming at least a part of an insulation layer, the channel having opposite legs extending on each side of the sheet and an interconnecting web with a longitudinal covered groove therein extending along the edge of the sheet, (b) pouring a first layer of concrete;

(c) setting the insulation layer onto the first concrete layer;

(d) pouring a second layer of concrete onto the insulation layer opposite the first concrete layer so as to define a first multi-layer wall panel;

(e) repeating steps (a)–(d) to define a second multi-layer wall panel;

(f) uncovering the grooves;

(g) positioning the first and second multi-layer wall panels adjacent one another so as to form a joint therebetween:

(h) placing a vapor barrier into the joint and into the grooves of the channel members on the adjacent panels so as to seal the joint from moisture.

10. The method of claim 9 wherein the vapor barrier is a film, and further comprising inserting a spline into each groove over the vapor film to secure the film in the grooves.

11. The method of claim 9 wherein the vapor barrier is a film on each wall panel having an end extending out of the joint.

12. The method of claim 11 further comprising pushing the ends of the vapor films into the joint.

13. The method of claim 12 further comprising rolling the ends of the vapor films together before pushing the ends into the joint.

14. The method of claim 12 further comprising sealing the joint with a sealing compound.

* * * * *